US007911490B2

(12) United States Patent
Mizukami

(10) Patent No.: US 7,911,490 B2
(45) Date of Patent: Mar. 22, 2011

(54) PRINTER

(75) Inventor: Junichi Mizukami, Iruma (JP)

(73) Assignee: Teac Corporation, Tama-shi (JP)

( * ) Notice: Subject to any disclaimer, the term of this patent is extended or adjusted under 35 U.S.C. 154(b) by 67 days.

(21) Appl. No.: 12/534,732

(22) Filed: Aug. 3, 2009

(65) Prior Publication Data

US 2010/0134585 A1 Jun. 3, 2010

(30) Foreign Application Priority Data

Aug. 5, 2008 (JP) ..... 2008-202248

(51) Int. Cl.
*B41J 3/407* (2006.01)
*B41J 2/325* (2006.01)

(52) U.S. Cl. ..... 347/213

(58) Field of Classification Search ..... 347/171, 347/172, 174, 176, 213, 216; 400/120.01, 400/120.02, 120.03
See application file for complete search history.

(56) References Cited

U.S. PATENT DOCUMENTS

| | | | | |
|---|---|---|---|---|
| 5,053,788 | A * | 10/1991 | Tohdo | 347/217 |
| 5,532,724 | A * | 7/1996 | Inagaki et al. | 347/213 |
| 6,377,291 | B2 * | 4/2002 | Andoh et al. | 347/213 |
| 6,486,904 | B1 * | 11/2002 | Onozato et al. | 347/213 |
| 6,639,618 | B2 * | 10/2003 | Nakamura et al. | 347/213 |
| 6,655,287 | B2 * | 12/2003 | Jojima et al. | 101/485 |
| 6,664,993 | B2 * | 12/2003 | Isono | 347/213 |
| 7,303,344 | B2 * | 12/2007 | Sukigara et al. | 400/120.13 |
| 2007/0264073 | A1 | 11/2007 | Hanada | |

FOREIGN PATENT DOCUMENTS

JP 2007301879 A 11/2007

* cited by examiner

*Primary Examiner* — Huan H Tran
(74) *Attorney, Agent, or Firm* — Seed IP Law Group PLLC

(57) ABSTRACT

A printer comprises a transfer assembly 56 for transferring a print image formed on an intermediate transfer sheet 42 to a print surface of a print medium 100, a print tray 12 on which the print medium 100 is placed, and a retaining roller 70 installed slightly downstream of the transfer assembly 56. The retaining roller 70 which is biased downward pushes the print medium 100 from above, to thereby prevent the print medium 100 from being lifted up.

5 Claims, 7 Drawing Sheets

PRINTER

PRIORITY INFORMATION

This application claims priority to Japanese Patent Application No. 2008-202248, filed on Aug. 5, 2008, which is incorporated herein by reference in its entirety.

BACKGROUND

1. Technical Field

The present invention relates to a printer which performs image printing on a print surface of a flat shaped print medium by a thermal transfer method.

2. Related Art

Conventionally, printers for performing printing on print media which are stiff and shaped like plates, such as optical disks or magnetic cards, have been known (for example, refer to Japanese patent publication JP 2007-301879 A). In some such printers, the print medium is usually placed on a print tray and transported with the print tray. A recessed section which has a shape conforming to an outside shape of the print medium is formed on the print tray. Then, positioning of a recording medium relative to the print tray is achieved by placing and housing the print medium in the recessed section. On the other hand, a print tray for a printer in which an optical disc is used as the print medium is equipped with a plurality of clamping lugs which are brought into intimate contact with a circumferential edge of an opening (center hole) formed in the center of the optical disc, to thereby clamp the optical disc. Then, the optical disc is retained by the clamping lugs and accordingly prevented from unintentional dropping off or lifting up. However, the clamping lugs effectively function only for optical discs having a center hole, while flat shaped print media having no center hole, such as magnetic cards or IC cards, are typically simply placed on the print tray in many cases.

In the printer as described above, a sheet material on which a print image is formed is pressed against a print surface of the print medium in a planar manner by a heat roller and a separation roller, to thereby realize print processing. When the print image is pressed against the print surface, the print image is transferred to the print surface. Here, the heat roller is a roller containing in the inside thereof a heat source, and the ink that constitutes the print image is heated by the heat source and accordingly fused. On the other hand, the separation roller is a roller installed at a separating position where the sheet material pressed against the print surface is separated from the print surface. Upon reaching a location of the separation roller, a forwarding direction of the sheet material which has been substantially parallel to the print surface is turned to an obliquely upward direction. Then, the turning of the forwarding direction to the obliquely upward direction causes the sheet material to be separated from the print surface.

However, for the print medium in which the center hole is not provided, the above-described separation of the sheet material subsequent to a transfer process could not be realized smoothly and efficiently in some cases. Namely, the print medium having no center hole is simply placed on the print tray as described above without any mechanism to prevent the print medium from being lifted up. Therefore, when the sheet member is forwarded to the obliquely upward direction for separation, the print medium might be lifted obliquely upward while adhering to the sheet member in some cases. Accordingly, there have been problems that the print image is not sufficiently transferred, and that failure is caused by taking up the sheet member with the print medium which remains affixed to the sheet member.

Hence, the present invention advantageously provides a printer capable of performing print processing in a smooth and efficient manner even on a print medium in which a center hole is absent.

SUMMARY

According to the present invention, a printer for performing image printing on a print surface of a plate-shaped print medium using a thermal transfer method comprises a printing unit that transfers a print image formed on a sheet material to the print surface for performing the image printing on the print surface, a print tray on which the print medium is placed with the print surface being exposed, the print tray moving relative to the printing unit along a predetermined print proceeding direction when the print image is transferred. In the printer, the printing unit comprises the sheet material, on which the formed print image is formed, the sheet material being taken up in synchronization with relative movement of the print tray along the print proceeding direction, a transfer assembly for pressing the sheet material against the print surface to transfer the print image to the print surface, and a retaining member which is installed to push the print medium from above and located, in a printing direction, downstream of a separating position where a forwarding direction of the sheet is turned to separate the sheet material having been pressed against the print surface from the print surface.

In a preferable embodiment, the printer further comprises a biasing means for exerting a force on the retaining member along a direction of pushing down the print tray. It is further preferable that the print tray has an end edge formed into a bevel (a slanting edge), the end edge being located downstream in the printing direction.

Further, in another preferred embodiment, the retaining member may be switched, depending on advancing and retreating conditions of the print tray, between a lowered state where the retaining member has been lowered to push an upper surface of the print tray, and an elevated state where the retaining member has been elevated to keep away from the upper surface of the print tray. In this case, the printer further comprises a cam pin attached to one of the retaining member or the print tray and a cam groove formed in the other of the retaining member or the print tray to receive the cam pin, the cam groove defining a path of relative movement between the cam pin and the cam groove corresponding to advancing and retreating motions of the print tray. Further, the cam groove has a shape such that the path of the relative movement during the advancing motion of the print tray is different from the path of the relative movement during the retreating motion of the print tray.

According to the present invention, the print medium is pushed down by the retaining member installed downstream from the separating position in the printing direction, to thereby prevent lifting of the print medium. Then, in this way, because the sheet member is always separated with reliability, print processing can be performed smoothly and efficiently.

BRIEF DESCRIPTION OF THE DRAWINGS

A preferred embodiment of the present invention will be described in detail based on the following figures, wherein.

DETAILED DESCRIPTION

Figure 1:
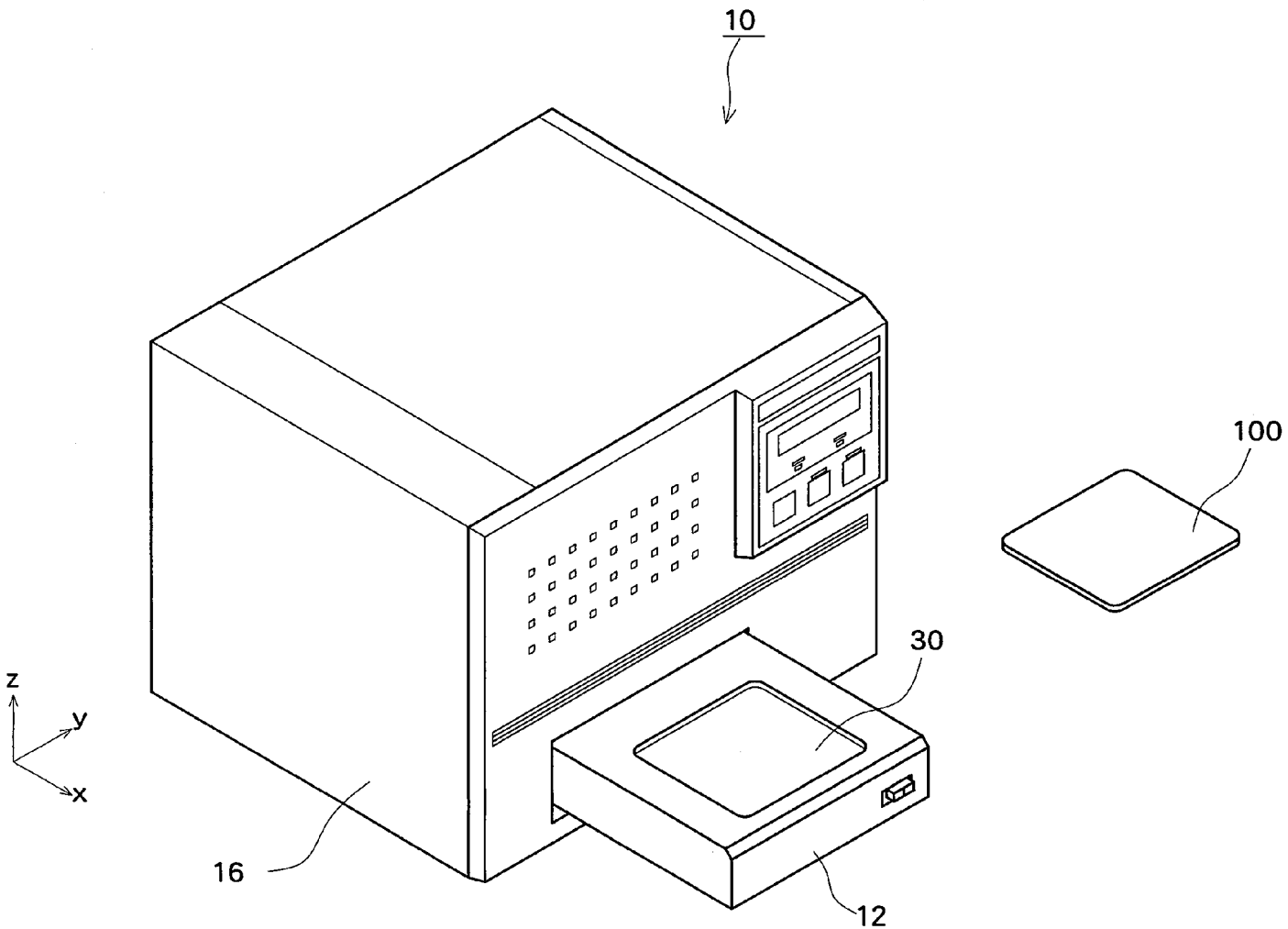
FIG. 1 is a perspective view of a printer according to an embodiment of the present invention.
Figure 2:
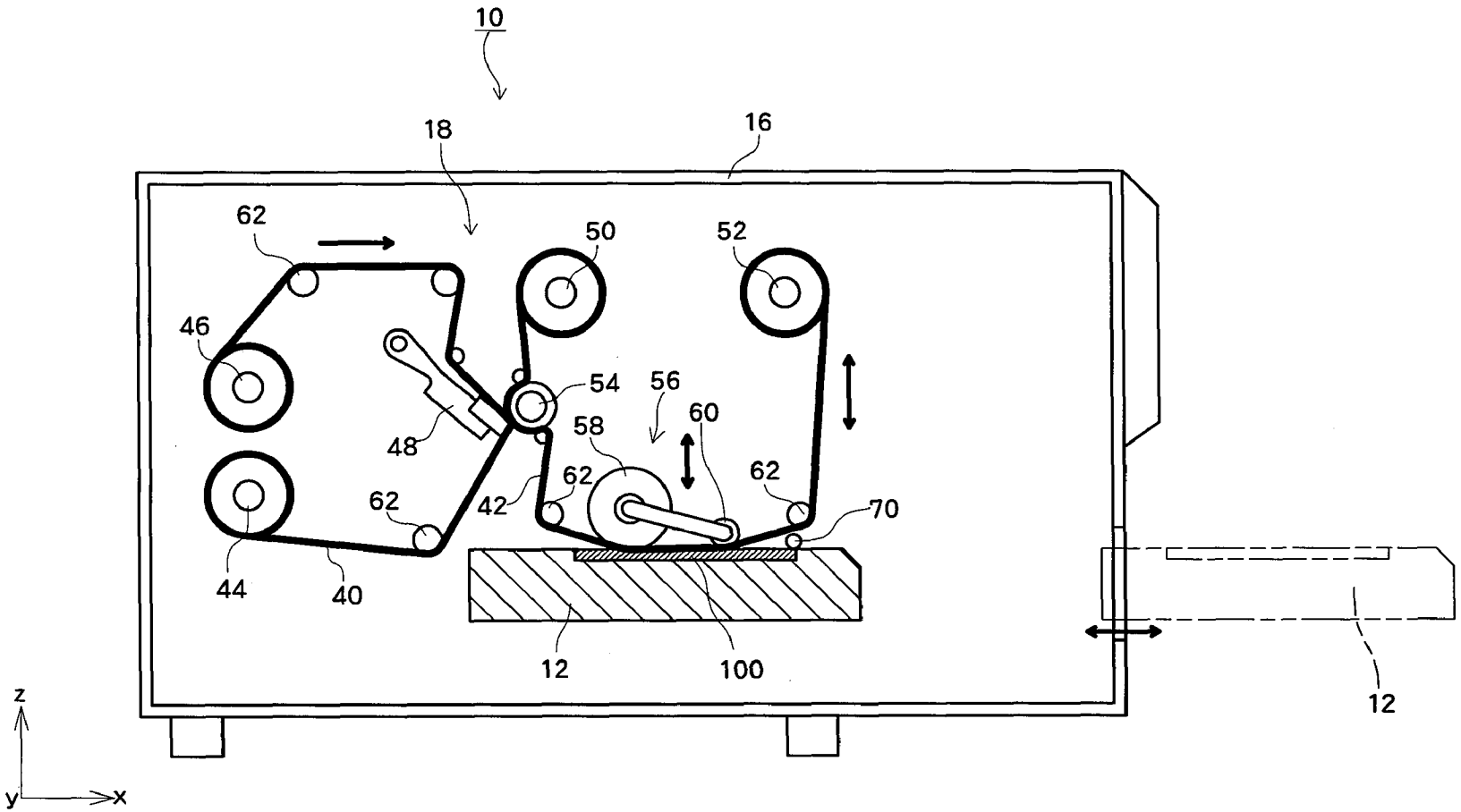
FIG. 2 shows a schematic configuration of the printer.

A preferred embodiment of the present invention will be described hereunder by reference to the drawings. FIG. 1 is a perspective view of a printer 10 according to the embodiment of this invention, and FIG. 2 shows a schematic configuration of the printer 10. The printer 10 is an apparatus for performing print processing of a print medium which is relatively thick and stiff, such as, for example, a magnetic card or an IC card.

A print medium 100 is transported while being supported by a print tray 12. The print tray 12 can advance and retreat along a direction (an X direction in FIGS. 1 and 2) substantially orthogonal to a rotation axis of a heat roller 58 which will be described below. Then, when the print tray 12 advances or retreats, the print medium 100 supported by the print tray 12 is transported to the outside or inside of a housing 16. A housing recess 30 is formed on an upper surface of the print tray 12 in which the print medium 100 is placed and housed in the housing recess 30. The housing recess 30 has a shape conforming with an outer peripheral shape of the print medium 100, so that positioning of the print medium 100 relative to the print tray 12 is appropriately achieved by placing the print medium 100 in the housing recess 30.

In addition, the print tray 12 may be composed of a tray main body attached to the printer 10 and an adapter removably connected to the tray main body in order to enable the printer 10 to accept print media 100 of various shapes. In this case, an adapter is prepared for each shape category of the print media 100, and a plurality of adapters are accordingly provided. Further, the housing recess 30 whose shape conforms with the outer peripheral shape of the corresponding print medium 100 is formed on each of the adapters. Then, from among the plurality of adapters, a user may select one adapter corresponding to a desired print medium 100 on which printing is desired, and attaches the thus-selected adapter to the tray main body for use.

Next, a printing unit 18 installed in the printer 10 will be described with reference to FIG. 2. The printing unit 18 according to the present embodiment performs printing using a thermal transfer method in which ink of an ink ribbon 40 is transferred to an intermediate transfer sheet 42, and then the ink (a print image) having been transferred to the intermediate transfer sheet 42 is subsequently transferred from the intermediate transfer sheet 42 onto a print surface of the print medium 100. In the ink ribbon 40, ink of a plurality of colors, for example four, is repeatedly arranged along a longitudinal direction of the ribbon. Inks suitable for the ink ribbon 40 include thermofusible ink and sublimation ink, but the configuration of the printer 10 and the transfer process are similar regardless of the type of ink used. Hence, in the following, an example in which a thermofusible ink is used will be described. This ink ribbon 40 is fed from a ribbon delivery bobbin 46, guided by a plurality of guide rollers 62, and sequentially picked up by a ribbon take-up bobbin 44. At any suitable position along the way of take-up of this ribbon, there is provided a thermal head 48 which brings the ink ribbon 40 into direct contact with the intermediate transfer sheet 42 and fuses the ink on the surface of the ink ribbon 40. A plurality of heating elements (not shown) are provided in the thermal head 48.

In response to a command from a control unit (not shown), the thermal head 48 selectively heats the plurality of heating elements, to thereby partially fuse the ink of the ink ribbon 40. When the ink ribbon 40 whose ink is partially fused is pressed against the intermediate transfer sheet 42, the fused ink is transferred to the intermediate transfer sheet 42.

The intermediate transfer sheet 42 is fed from a sheet feed bobbin 50, guided by a plurality of guide rollers 62, and taken up by a sheet take-up bobbin 52. A platen roller 54 which receives pressure from the thermal head 48 is provided at an arbitrary position along the way of take-up of the intermediate transfer sheet 42. As a result of the thermal head 48 pressing the ink ribbon 40 toward the platen roller 54, the ink fused by heat from the thermal head 48 is transferred to the intermediate transfer sheet 42 fed along the platen roller 54.

As described above, ink of the plurality of colors is repeatedly arranged on the surface of the ink ribbon 40 along the longitudinal direction of the ink ribbon 40. When a full-color image is printed, all the plurality of colors of ink must have been transferred onto the intermediate transfer sheet 42 in advance. Accordingly, in the case of full-color printing, the intermediate transfer sheet 42 is taken up by the sheet feed bobbin 50 every time transfer of ink of one color affixed to the surface of the ink ribbon 40 is completed. The intermediate transfer sheet 42 is again transported from the sheet feed bobbin 50 to the sheet take-up bobbin 52 in order for the next color of ink to be transferred. The number of repetitions of transfer of ink and transportation of the sheet corresponds to the number of colors of ink on the ink ribbon 40 in order to form a full-color print image on the surface of the intermediate transfer sheet 42.

The full-color print image formed on the intermediate transfer sheet 42 is finally transferred onto the print surface of the print medium 100 by means of a transfer assembly 56. The transfer assembly 56 is a component in which the heat roller 58, including the heating elements in the inside thereof, is connected to a separation roller 60 located downstream of the heat roller 58. During the course of transfer of ink from the ink ribbon 40 to the intermediate transfer sheet 42, the transfer assembly 56 is raised to a height at which the transfer assembly 56 is located away from the print medium 100. Meanwhile, when the transfer of ink from the ink ribbon 40 to the intermediate transfer sheet 42 is completed and the full-color print image is formed on the intermediate transfer sheet 42, the transfer assembly 56 descends to press the intermediate transfer sheet 42 against the print surface of the print medium 100. In this state, the heat roller 58 and the separation roller 60 are arranged in such a manner that the heights of their lower ends are at substantially the same level. Therefore, when the transfer assembly 56 is moved down, the intermediate transfer sheet 42 located between the heat roller 58 and the separation roller 60 is brought into contact with the print surface in the form of plane contact. Because the intermediate transfer sheet 42 is thus contacted, as plane contact, with the print surface for a predetermined period of time, poor transfer or other failure caused by premature separation of the intermediate transfer sheet 42 from the print surface can be prevented.

During this pressing process, the ink transferred to the intermediate transfer sheet 42 is fused by the heating elements incorporated into the heat roller 58. Further, during the pressing process, the intermediate transfer sheet 42 is taken up to the sheet take-up bobbin 52 at a constant speed. The print tray 12 is moved together with the intermediate transfer sheet 42 along the same direction at the same speed. In other words, the print tray 12 moves relative to the transfer assembly 56 during the pressing process. Then, operation of the heat roller 58 and the print tray 12 causes the full-color print image formed on the intermediate transfer sheet 42 to be finally transferred onto the print surface, whereby printing of the image is implemented.

Here, as is evident from FIG. 2, the intermediate transfer sheet 42 is forwarded between the heat roller 58 and the separation roller 60 along a direction parallel to the print surface, and forwarded in a downstream side of the separation roller 60 along a slanting direction relative to the print surface. In other words, a forwarding direction of the intermediate transfer sheet 42 is turned upon reaching a separating position where the separation roller 50 is installed. Thus, the intermediate transfer sheet 42 will be separated from the print surface by turning the forwarding direction as described above.

Figure 8:
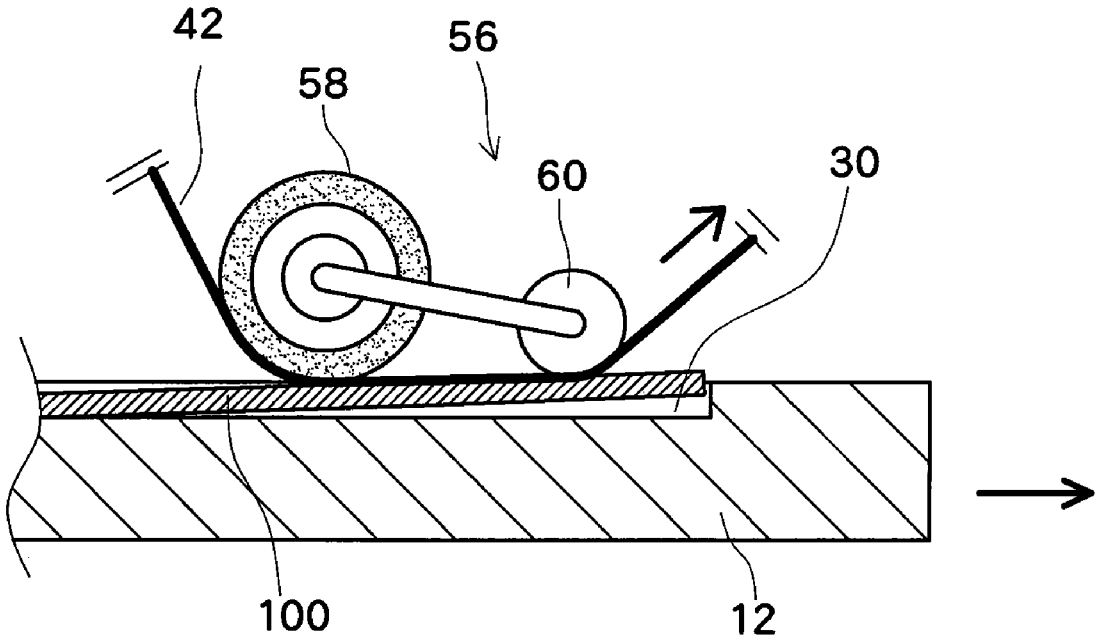
FIG. 8 is an enlarged view of a portion around a transfer assembly in a conventional printer.

In addition to the above-described configuration, the printer 10 according to this embodiment further comprises a retaining roller 70 in order to further ensure that the separation of the intermediate transfer sheet 42 is performed with reliability. Before describing the retaining roller 70 in detail, conventional problems will be briefly explained with reference to FIG. 8. FIG. 8 is an enlarged view of a part around the transfer assembly 56 in a conventional printer. In this conventional printer, the print medium 100 is simply placed in the housing recess 30, and a mechanism to prevent lifting of the print medium 100 is not provided. In such a configuration, it is assumed that the print medium 100 is transported downstream in a state where the intermediate transfer sheet 42 is pressed against the print medium 100. Here, on reaching the separating position where the separation roller 60 is installed, the intermediate transfer sheet 42 should be independently forwarded along an obliquely upward direction while the print medium 100 should be moved along a horizontal direction, thereby causing separation between the intermediate transfer sheet 42 and the print medium 100 as originally intended. However, in the conventional printer where the mechanism to prevent lifting of the print medium 100 is absent, the fused ink might function in some cases just as an adhesive for affixing the print medium 100 to the intermediate transfer sheet 42. As a result, the print medium 100, which remains affixed to the intermediate transfer sheet 42 even after passing through the separating position, might sometimes be lifted obliquely upward together with the intermediate transfer sheet 42. In this situation, there has been a problem that transfer of the print image to the print surface might be insufficient. In addition, the print medium 100 might be taken up together with the intermediate transfer sheet 42, resulting in a breakdown of the printer 10.

Here, when a print medium has, at a substantial center thereof, an opening (a center hole) like a CD or a DVD, the above-described problem of lifting up the print medium 100 can be circumvented by installing, in the print tray, clamping lugs to be engaged with a circumferential edge of the center hole. More specifically, for the print medium 100 such as a CD having the center hole, it is possible to retain the print medium 100 by tightly coupling the clamping lugs capable of moving in a radial direction to the circumferential edge of the center hole, which can, in turn, prevent the print medium 100 from lifting up.

However, for a magnetic card or an IC card, it is not possible to prevent the lifting by means of the clamping lugs as described above because of the absence of the center hole. Further, it is not inconceivable to have a way of holding the circumferential edge of the card (the print medium 100) from above using a lug or other components. In this case, however, printing cannot be performed on the circumferential edge, resulting in a problem that constraint on a design of the print image is increased.

Taking this situation into account, in the present embodiment, the retaining roller 70 is provided in order to implement satisfactory printing even on the print medium which is shaped like a flat plate having no center hole. The retaining roller 70 is a roller installed to facilitate smooth and efficient separation of the intermediate transfer sheet 42 from the print surface. As shown in FIG. 2, the retaining roller 70 is installed slightly downstream of the separation roller 60 and located below the intermediate transfer sheet 42 being forwarded in the obliquely upward direction and above the print tray 12.

Figure 3:
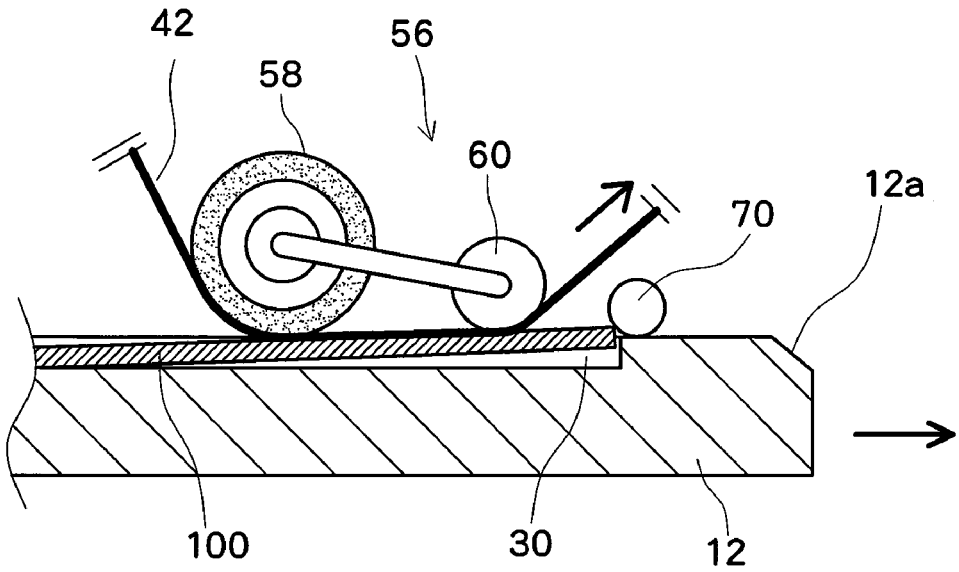
FIG. 3 is an enlarged view of a portion around a transfer assembly.
Figure 4:
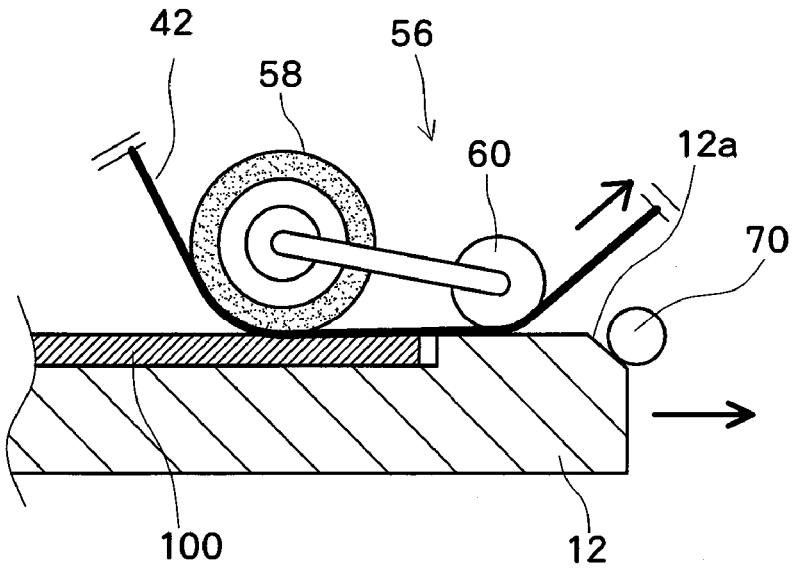
FIG. 4 is an enlarged view of the portion around the transfer assembly.

The retaining roller 70 is biased in a downward direction, i.e. a direction of pushing down the upper surface of the print tray 12 by a biasing means such as a spring (not shown), and lifting of the print medium 100 is prevented by this biasing force. Referring to FIG. 3, action of the retaining roller 70 will be specifically described. FIG. 3 is an enlarged view of a portion around the transfer assembly 56 in the printer according to this embodiment.

As has been discussed, because the transfer assembly 56 presses the intermediate transfer sheet 42 against the print medium 100, the print medium 100 is affixed to the intermediate transfer sheet 42 by viscosity (adhesive property) of the fused ink. Then, the print medium 100 tries to lift up while remaining affixed to the intermediate transfer sheet 42 even after passing across the separating position where the intermediate transfer sheet 42 undergoes direction change (an installation position of the separation roller 60). The retaining roller 70 which is located slightly downstream of the separation roller 60 downwardly pushes the print medium 100 which is trying to lift up, to thereby prevent lifting of the print medium 100. As a result, taking up the print medium 100 together with the intermediate transfer sheet 42 is also prevented, thereby ensuring reliable separation of the intermediate transfer sheet 42 from the print medium 100 in the vicinity of the separation roller 60. In this manner, the print image can be properly transferred on the print surface, so that excellent print quality is obtained.

In addition, a forward end of the print tray 12 has a bevel 12*a* for allowing the retaining roller 70 to easily go up onto the print tray 12. More specifically, the print tray 12 usually starts an advancing motion to perform transfer processing after retreating to an innermost side. During the advancing motion, the retaining roller 70 may impinge upon a forward end surface of the print tray 12 and interfere with the forward end surface in some cases. Then, if there is the bevel 12*a* formed on the forward end of the print tray 12, the retaining roller 70 will undergo relative movement along a surface of the bevel 12*a* and become able to easily go up onto the print tray 12.

Note that the retaining roller 70 is a member which makes physical contact directly with the print surface of the print medium 100 without intervention by the intermediate transfer sheet 42 or the like. In general, it is desirable to restrict the direct physical contact between the print surface and another component to the minimum necessary, in order to prevent flaws or dirt. For this reason, the retaining roller 70 is designed to have a special structure for suppressing the physical contact between the retaining roller 70 and the print surface in this embodiment.

Specifically, the retaining roller 70 is switched between a lowered state in which the retaining roller 70 has been lowered to push the upper surface of the print tray, and an elevated state where the retaining roller 70 has been elevated to keep away from the upper surface of the print tray, depending on advancing and retracting motions of the print tray 12. More specifically, in this embodiment, while the print tray 12 is advancing from a predetermined printing start position to a printing end position to transfer the print image to the print surface, the retaining roller 70 has been lowered so as to be capable of pushing down the print surface or the upper surface of the print surface. On the other hand, during a pullback operation for retreating the print tray 12 from a medium removal position where the housing recess 30 is exposed to the outside (where the print tray 12 is projected out of the housing 16) to the printing start position, and during an ejection operation for advancing the print tray 12 from the printing end position to the medium removal position, the retaining roller 70 has been elevated to prevent the retaining roller 70 from making physical contact with the upper surface of the print tray 12.

Although ascent and descent operations of the retaining roller 70 may be achieved by means of an electrically controllable drive source such as a motor, the operation is performed through mechanical interaction between the retaining roller 70 and the print tray 12 in this embodiment. This will be described with reference to FIGS. 5 to 7.

Figure 5:
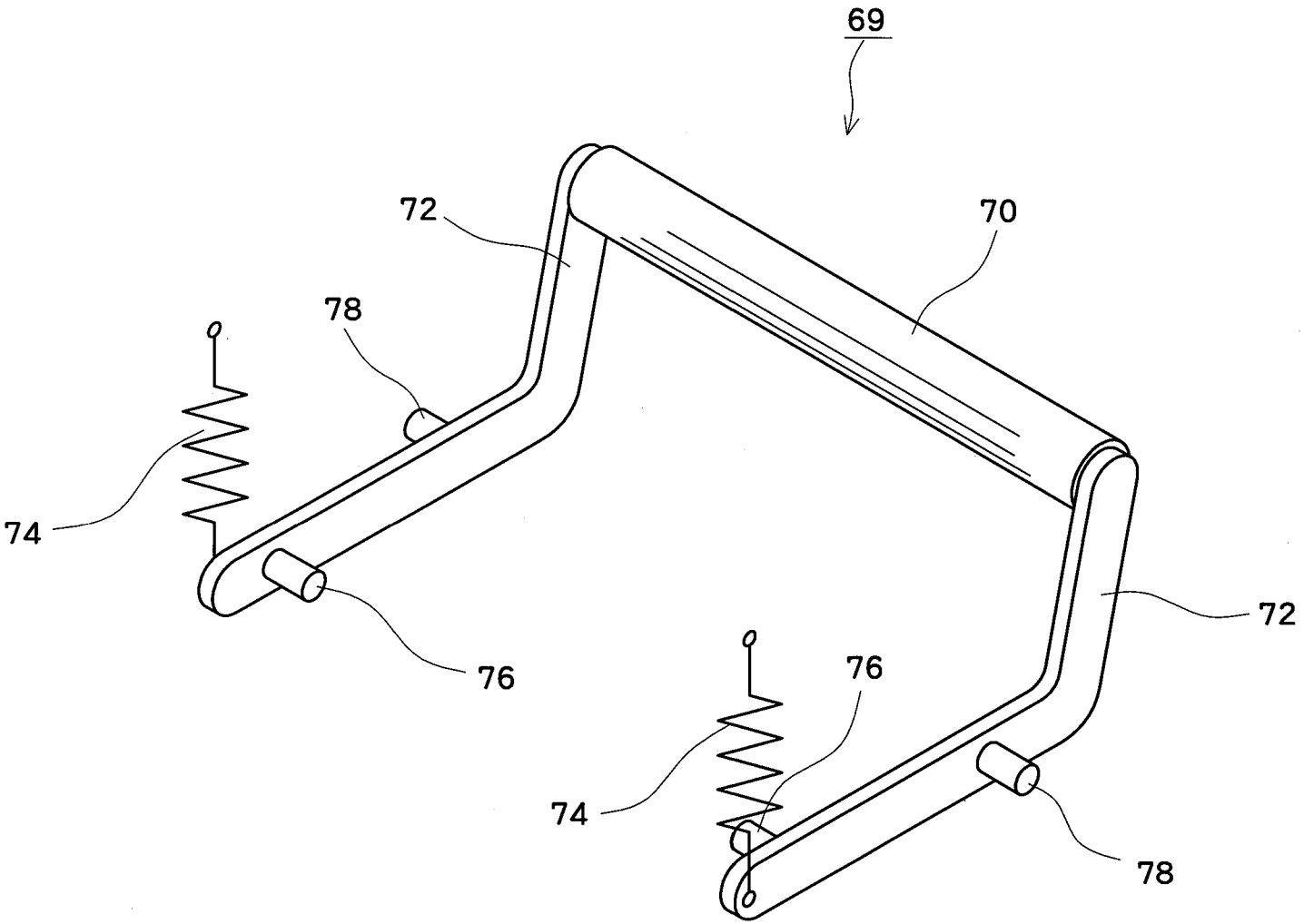
FIG. 5 is a schematic perspective view of a roller unit.

FIG. 5 is a schematic perspective view of a roller unit 69 into which the retaining roller 70 used in this embodiment is unitized with other components. The roller unit 69 comprises the retaining roller 70 for pushing the print surface and a pair of support arms 72 for supporting the retaining roller 70 from both sides. The retaining roller 70 is a cylindrical member rotatably held by the pair of support arms 72. Lifting of the print medium 100 is prevented by the retaining roller 70 pushing the print surface of the print medium 100. Further, it is desirable that an outer surface of the retaining roller 70 is composed of an elastic material such as rubber to avoid damage to the print medium 100.

The support arm 72 for supporting the retaining roller 70 is, for example, a roughly L-shaped member. A front end of the support arm 72 is provided with a support axis (not shown) for rotatably holding the retaining roller 70. On the other hand, a rear end of the support arms 72 is suspended and retained by a coil spring 74. The coil spring 74 functions as a biasing means for exerting a force on the retaining roller 70 along a direction of pushing down the print tray 12. One end of the coil spring 74 is attached to the rear end of the support arm 72, while the other end of the coil spring 74 is attached to a fixed member such as a chassis (not shown) of the printer 10. The rear end of the support arm 72 is biased upward by the coil spring 74.

In addition, a cam pin 76 and a swing shaft 78 are protrudingly formed on the support arm 72. The swing shaft 78 is a shaft to be inserted into a shaft hole (not shown) provided in the fixed member such as a chassis of the printer 10. The support arm 72 swings around the swing shaft 78. Then, a swing of the support arm 72 can cause the retaining roller 70 to ascend or descend. The cam pin 76 is a pin mounted on a rear end side of the swing shaft 78. The cam pin 76 is inserted into a cam groove 80 formed on a side surface of the print tray 12. Then, the swing of the support arm 72, and thus ascending and descending actions of the retaining roller 70, is implemented by an engagement relationship between the cam pin 76 and the cam groove 80.

Figure 6:
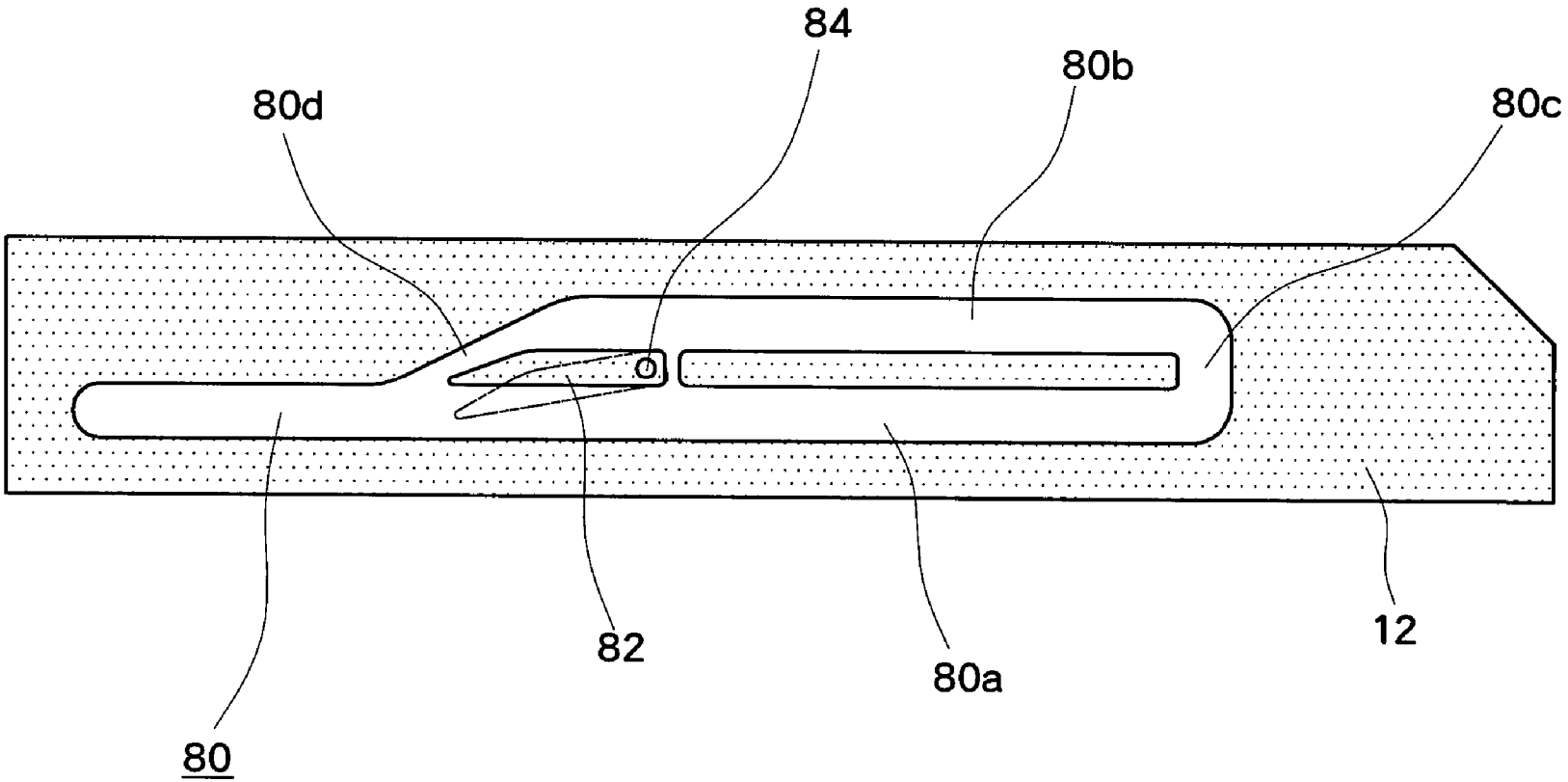
FIG. 6 is a schematic side view of a print tray.

Next, the cam groove 80 formed on the side surface of the print tray 12 will be described with reference to FIG. 6. FIG. 6 is a schematic side view of the print tray 12. Note that in FIG. 6, areas other than the cam groove 80 are shown hatched to facilitate understanding. The cam groove 80 in which the cam pin 76 is inserted and engaged is formed on the side surface of the print tray 12. The cam groove 80 has a shape of a laid down numeral "6" as shown in FIG. 6. More specifically, the cam groove 80 generally consists of four grooves. A first groove 80*a* is a groove extending in the form of a straight line along the advancing/retreating direction of the print tray 12. A second groove 80*b* is a groove formed above the first groove 80*a* and extending in parallel with the first groove 80*a*. However, the second groove 80*b* is shorter than the first groove 80*a*, and a posterior end of the second groove 80*b* is located in a more forward position than a posterior end of the first groove 80*a*. A third groove 80*c* is a groove for connecting the anterior ends of the first groove 80*a* and the second groove 80*b* with each other, and extends along a substantially vertical direction. It should be noted that each groove width of the first, second, and third grooves 80*a*, 80*b*, and 80*c* is slightly larger than a diameter of the cam pin 76 so that the cam pin 76 can move within the grooves. A fourth groove 80*d* is a groove for connecting the posterior end of the second groove 80*b* and an approximate middle position of the first groove 80*a*, and is gently inclined. A groove width of the fourth groove 80*d*, which is smaller than the diameter of the cam pin 76 in an initial state, can be expanded from the initial state by a pivoting motion of a pivot valve 82. The pivot valve 82 is a valve body for adjusting the groove width of the fourth groove 80*d*, and is capable of pivoting around a pivot axis 84. A biasing member such as a spring (not shown) is attached to the pivot valve 82 for forcing the pivot valve 82 to return to the initial state where the groove width is smaller than the diameter of the cam pin 76.

Next, the mechanical interaction between the roller unit 69 and the print tray 12 will be described with reference to FIG. 7. FIGS. 7A to 7D are schematic side views showing the roller unit 69 and the print tray 12. As can be clearly seen from FIGS. 7A to 7D, a position (height) of the cam pin 76 is changed in response to the advancing and retreating motions of the print tray 12. On the other hand, because the swing shaft 78 is inserted into the shaft hole formed in the fixed member, the position of the swing shaft 78 remains unchanged. Then, as a relative position between the cam pin 76 and the swing shaft 78 changes, an angle of inclination of the support arms 72 is changed, thereby causing the retaining roller 70 to descend or ascend. This will be described in detail below.

Figure 7A:
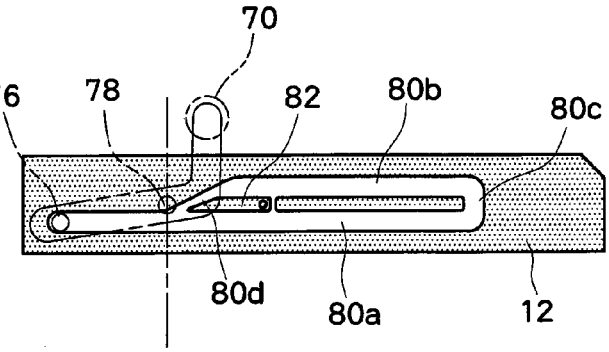
FIG. 7A is a schematic side view of the roller unit and the print tray.

To perform print processing on the print medium 100, the print tray 12 is advanced to the medium removal position where the housing recess 30 is exposed outside the housing 16. FIG. 7A shows the print tray 12 which has reached the medium removal position. As can be seen from FIG. 7A, when the print tray 12 stays at the medium removal position, the cam pin 76 is located at the posterior end of the first groove 80*a*. The angle of the support arms 72, and thus the height of the retaining roller 70, is defined by a relative position (height) between the cam pin 76 and the swing shaft 78 whose position remains unchanged. In this embodiment, the cam groove 80 and others are formed into shapes that define a height at which the retaining roller 70 is maintained away from the print tray 12 when the cam pin 76 is engaged in the first groove 80*a*.

Figure 7B:
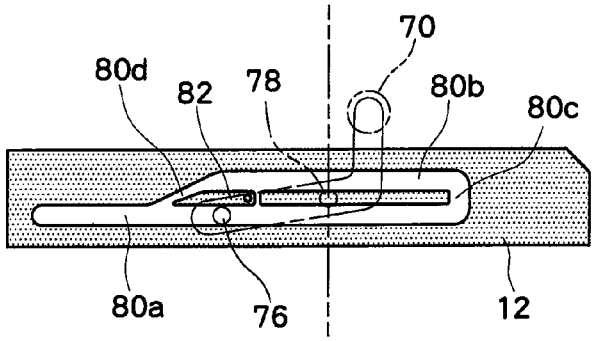
FIG. 7B is a schematic side view of the roller unit and the print tray.

A user places the print medium 100 in the housing recess 30 of the print tray 12 advanced to the medium removal position. Upon placement of the print medium 100, the print tray 12 performs its pullback operation for retreating to the inner side. FIG. 7B shows a way of performing the pullback operation. As shown in FIG. 7B, the cam pin 76 undergoes relative movement along the first groove 80*a* when the pullback operation is performed (the cam pin 76 does not actually move, while the print tray 12 moves instead). During the pullback operation, the retaining roller 70 remains elevated to the height at which the retaining roller 70 keeps away from the upper surface of the print tray 12. It should be noted that because the fourth groove 80*d* is closed by the pivot valve 82, the cam pin 76 is not allowed to slide into the fourth groove 80*d*.

Figure 7C:
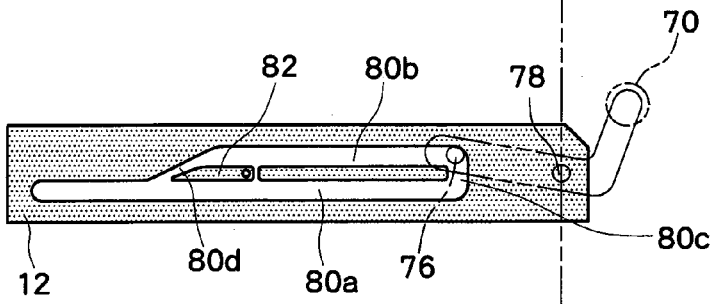
FIG. 7C is a schematic side view of the roller unit and the print tray.

The pullback operation is performed until the print tray 12 reaches the printing start position. FIG. 7C shows the print tray 12 which has arrived at the printing start position. When the print tray 12 arrives at the printing start position, the cam pin 76 reaches the anterior end of the first groove 80*a* (which also constitutes a lower end of the third groove 80*c*). Here, an upward force is exerted on the rear ends of the support arms 76 by the spring. The cam pin 76 that has arrived at the anterior end of the first groove 80*a* is moved by the upward force within the third groove 80*c* extending along the substantially vertical direction to the second groove 80*b* located above the first groove 80*a*. When the cam pin 76 moves into the second groove 80*b*, i.e. when the cam pin 76 ascends, the retaining roller 70 located on the opposite side of the swing shaft 78 descends, contrary to the cam pin 76. As a result, it becomes possible for the retaining roller 70 to push the upper surface of the print tray 12 and therefore the print medium 100.

Upon arrival of the print tray 12 at the printing start position, actual transfer processing for transferring the print image to the print surface is started. During the transfer processing, the print tray 12 is gradually advanced simultaneously with the intermediate transfer sheet 42 being taken up. In the course of this advancing motion, the cam pin 76 undergoes relative movement along the second groove 80*b*, while the retaining roller 70 is maintained in the lowered state. As a result, lifting of the print medium 100 is prevented by the retaining roller 70 as described above, which makes it possible to obtain excellent print quality.

Figure 7D:
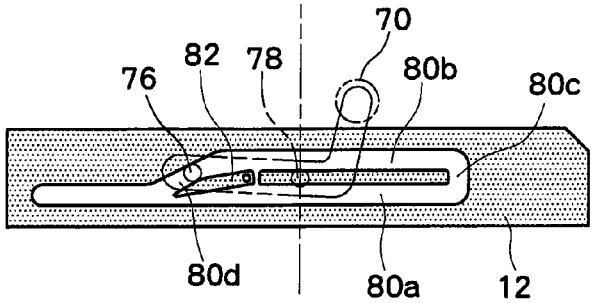
FIG. 7D is a schematic side view of the roller unit and the print tray.

When the transfer processing is completed, the print tray 12 arrives at the printing end position. Upon arrival of the print tray 12 at the printing end position, the cam pin 76 reaches the posterior end of the second groove 80*b* (which also constitutes the anterior end of the fourth groove 80*d*). After the completion of the transfer processing, the print tray 12 further performs its ejection operation in which the print tray 12 advances to the medium removal position to allow removal of the print medium 100 having been printed. The ejection operation (advancing motion) causes relative movement of the cam pin 76 along the fourth groove 80*d*. FIG. 7D is a diagram showing a situation during the ejection operation. In this situation, the pivot valve 82 is depressed down by the cam pin 76 and accordingly pivoted in a direction of increasing the groove width of the fourth groove 80*d*. In this way, the cam pin 76 is allowed to move within the fourth groove 80*d*. In other words, the cam pin 76 is gradually lowered along the fourth groove 80*d*. As the cam pin 76 is lowered, the retaining roller 70 located on the opposite side of the swing shaft 78 is, contrary to the cam pin 76, elevated. In this way, the retaining roller 70 is located away from the upper surface of the print tray. Upon arrival at the first groove 80*a*, the cam pin 76 undergoes relative movement along the first groove 80*a*. Then, after the print tray 12 reaches the medium removal position, a sequence of print processing is completed when the printed print medium 100 is taken out by the user.

As will be clearly understood from the above description, a path of relative movement of the cam pin 76 is established in such a manner that the path of relative movement during the retreating motion of the print tray is different from that during the advancing motion of the print tray in this embodiment. In this way, the retaining roller 70 can be lowered at a time of transfer processing and elevated at all other times, to thereby avoid more physical contact between the retaining roller 70 and the print surface than is necessary. It should be noted that the above-described configuration is disclosed by way of illustration, and other configurations may, of course, be implemented as long as the elevated state where the retaining roller 70 is elevated can be switched to the lowered state where the retaining roller 70 is lowered. For example, the cam pin may be formed on the print tray 12, while the cam groove may be formed in the roller unit 69. Alternatively or additionally, an electrically controllable drive source such as a motor may be used. In addition, the mechanism for elevating the retaining roller 70 may be omitted, provided that the retaining roller 70 is capable of at least pushing the print surface at the time of transfer processing. Further, although the roller is used as a retaining means for pushing the print surface, the retaining means is not limited to the roller, and a plate may be used as the retaining member when the plate is capable of pushing the print surface. Still further, the retaining means need not be biased by the biasing means as long as the retaining means can push the print medium. Moreover, the support arms 72 for supporting the retaining roller 70 are shaped almost like the letter L in this embodiment, but may be, of course, formed in other shapes. In any case, the print surface can be pushed down on a slightly downstream side of the separation roller 60 according to this embodiment. In this way, it becomes possible to reliably separate the intermediate transfer sheet 42 from the print surface, with a result that excellent print quality can be obtained.

What is claimed is:

1. A printer which performs image printing on a print surface of a plate-shaped print medium using a thermal transfer method comprising:

a printing unit which transfers a print image having been formed on a sheet material to the print surface to perform the image printing on the print surface, and a print tray on which the print medium is placed with the print surface being exposed, the print tray being moved relative to the printing unit along a predetermined print proceeding direction when the print image is transferred, wherein;

the printing unit comprises, the sheet material on which the print image is formed, the sheet material being taken up in synchronism with relative movement of the print tray along the print proceeding direction, a transfer assembly for pressing the sheet material against the print surface to transfer the print image to the print surface, and a retaining member which is installed to push the print medium from above and located, in a printing direction, downstream of a separating position where a forwarding direction of the sheet material is turned to separate the sheet material having been pressed against the print surface from the print surface.

2. A printer according to claim 1, further comprising:

a biasing means for exerting a force on the retaining member along a direction of pushing the print tray.

3. A printer according to claim 1, wherein:

the print tray has an end edge formed into a bevel, the end edge being located downstream in the printing direction.

4. A printer according to claim 1, wherein:

the retaining member is switched depending on advancing and retreating conditions of the print tray between a lowered state in which the retaining member has been lowered to push an upper surface of the print tray and an elevated state in which the retaining member has been elevated to keep away from the upper surface of the print tray.

5. A printer according to claim 4, further comprising:

a cam pin attached to one of the retaining member or the print tray, and a cam groove which is formed on the other of the retaining member or the print tray to receive the cam pin, the cam groove defining a path of relative movement between the cam pin and the cam groove corresponding to advancing and retreating motions of the print tray, wherein the cam groove has a shape in which the path of the relative movement during the retreating motion of the print tray is different from the path of the relative movement during the advancing motion of the print tray.

* * * * *